US010516937B2

(12) United States Patent
Borss et al.

(10) Patent No.: US 10,516,937 B2
(45) Date of Patent: Dec. 24, 2019

(54) DIFFERENTIAL SOUND REPRODUCTION

(71) Applicant: Fraunhofer-Gesellschaft zur Foerderung der angewandten Forschung e.V., Munich (DE)

(72) Inventors: Christian Borss, Erlangen (DE); Ville Saari, Nuremberg (DE); Markus Schmidt, Loerrach (DE); Christof Faller, Greifensee (CH); Andreas Walther, Feucht (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/727,783

(22) Filed: Oct. 9, 2017

(65) Prior Publication Data

US 2018/0035202 A1 Feb. 1, 2018

Related U.S. Application Data

(63) Continuation of application No. PCT/EP2016/057669, filed on Apr. 7, 2016.

(30) Foreign Application Priority Data

| | | |
|---|---|---|
| Apr. 10, 2015 | (EP) | 15163233 |
| Aug. 12, 2015 | (EP) | 15180745 |
| Sep. 30, 2015 | (EP) | 15187729 |

(51) Int. Cl.

| | |
|---|---|
| ***H04R 1/40*** | (2006.01) |
| ***H04R 3/12*** | (2006.01) |
| ***H04R 5/02*** | (2006.01) |

(52) U.S. Cl.

CPC ..... *H04R 1/403* (2013.01); *H04R 3/12* (2013.01); *H04R 5/02* (2013.01)

(58) Field of Classification Search

CPC ..... H04R 1/20; H04R 1/323; H04R 1/403; H04R 2201/40; H04R 2201/401; H04R 2201/403; H04R 2201/405

See application file for complete search history.

(56) References Cited

U.S. PATENT DOCUMENTS 5,870,484 A 2/1999 Greenberger et al.
6,128,395 A * 10/2000 DeVries (Continued)

FOREIGN PATENT DOCUMENTS

CN 101193459 A 6/2008
CN 101375630 A 2/2009

(Continued)

OTHER PUBLICATIONS

Bore, et al., "Mikrophone: Arbeitsweise und Ausführungsbeispiele", Druck-Centrum Fürst GmbH, Berlin, Germany, 4th edition 1999, 79 pages. (with machine translation).

(Continued)

*Primary Examiner* — Kile O Blair
(74) *Attorney, Agent, or Firm* — Michael A. Glenn; Perkins Coie LLP

(57) ABSTRACT

A calculation unit for a sound reproduction system includes an input unit, a processor and at least three outputs for controlling at least three transducers of an array. The input unit has the purpose to receive an audio stream to be reproduced using the array, wherein the audio stream has a frequency range. The processor is configured to calculate three individual audio signals to be output using the at least three outputs, such that a first acoustic differential having a second or higher order is generated using the array.

17 Claims, 10 Drawing Sheets

(56) References Cited

U.S. PATENT DOCUMENTS

| | | | |
|---|---|---|---|
| 6,584,203 | B2 | 6/2003 | Elko et al. |
| 8,351,616 | B1 | 1/2013 | Graber |
| 9,900,723 | B1 * | 2/2018 | Choisel |
| 2003/0185410 | A1 | 10/2003 | June et al. |
| 2006/0044419 | A1 | 3/2006 | Ozawa |
| 2008/0130922 | A1 | 6/2008 | Shibata et al. |
| 2008/0159571 | A1 | 7/2008 | Hooley |
| 2008/0273725 | A1 | 11/2008 | Hartung et al. |
| 2010/0246854 | A1 | 9/2010 | Aarts |
| 2013/0279723 | A1 | 10/2013 | Hooley et al. |

FOREIGN PATENT DOCUMENTS

| | | | |
|---|---|---|---|
| CN | 101401454 | A | 4/2009 |
| CN | 103181189 | A | 6/2013 |
| DE | 102007049407 | A1 | 4/2009 |
| EP | 1596627 | A2 | 11/2005 |
| EP | 2445228 | A2 | 4/2012 |
| JP | S6326198 | A | 2/1988 |
| JP | H06072253 | A | 3/1994 |
| JP | H09247784 | A | 9/1997 |
| JP | 2007274510 | A | 10/2007 |
| JP | 2010534047 | A | 10/2010 |
| JP | 2012169895 | A | 9/2012 |
| KR | 20030077797 | A | 10/2003 |
| WO | 2005/086526 | A1 | 9/2005 |
| WO | 2010/140104 | A1 | 12/2010 |
| WO | 2011/114252 | A1 | 9/2011 |
| WO | 2011161567 | A1 | 12/2011 |

OTHER PUBLICATIONS

Gudvangen, "Properties of Gradient Loudspeakers", AES 136th Convention, Berlin, Germany, Apr. 2014, pp. 1-10.

Olson, "Gradient Loudspeakers", Journal of the Audio Engineering Society; vol. 21; No. 2, Mar. 1973, pp. 86-93.

Olson, "Gradient microphones", The Journal of the Acoustical Society of America, vol. 17, No. 3, Jan. 1946, pp. 192-198.

* cited by examiner

DIFFERENTIAL SOUND REPRODUCTION

CROSS-REFERENCES TO RELATED APPLICATIONS

This application is a continuation of copending International Application No. PCT/EP2016/057669, filed Apr. 7, 2016, which is incorporated herein its entirety by this reference thereto, which claims priority from European Applications Nos. EP 15 163 233.8, filed Apr. 10, 2015, EP 15 180 745.0, filed Aug. 12, 2015 and EP15 187 729.7, filed Sep. 30, 2015, each of which is incorporated herein in its entirety by this reference thereto.

Embodiments of the present invention refer to a calculation unit for a sound reproduction system, a corresponding method and to a system comprising the calculation unit and an array.

BACKGROUND OF THE INVENTION

Some sound reproduction systems are based on so-called differential sound reproduction approaches. Due to differential sound reproduction a directivity pattern may be reproduced. Directivity patterns are known from directive microphones. Directive microphones are usually implemented by means of measuring a sound pressure gradient or an approximation thereof, as described e.g. in the publications of G. Bore and S. Peus having the title "Mikrophone: Arbeitsweise and Ausfuhrungsbeispiele" and of H. Olson having the title "Gradient microphones". For example, a first order gradient has a figure-of-eight directivity pattern. By delaying one channel, when measuring a sound pressure difference, one can achieve directivity patterns such as cardioid or tailed cardioids. First order differential or gradient microphones are the standard in directive microphones.

Used less frequently, the same concept can also be applied to loudspeakers, as can be seen by the publication of H. Olson having the title "Gradient loudspeakers". Though, the dimensions are about an order of magnitude larger, giving rise to different properties/limitations.

Such concepts for differential loudspeaker arrays have, when compared to conventional delay-and-sum-beamformers, the advantages of a need for only a few loudspeakers, in contrast to delay-and-sum-arrays usually featuring many loudspeakers. Furthermore, with a smaller aperture than a delay-and-sum-beamformer, the same directivity can be achieved at low frequencies.

The Patent Application WO 2011/161567 A1 discloses a dipole related processing for a loudspeaker arrangement comprising three or more transducers. In the described three driver setup, the two outermost drivers are driven in a dipole configuration (unsteered). The driver in between those two is used to produce a notch that may be steered towards the listening position. This is achieved by a (frequency selective) relative offset of the second driver signal. Here, equally spaced drivers (i.e. the distance from the first to the second driver is equal to a distance from a second to a third driver) may be used. The signal that is generated for the middle driver can have a phase difference and a (frequency selective) gain relative to the dipole configuration.

The U.S. Pat. No. 5,870,484 discloses a sound reproduction system that uses gradient loudspeakers. This publication describes in detail how dipole systems can be created, e.g. using either two or three loudspeakers, or one loudspeaker and a passive opening to achieve the dipole effect. Here, the usage of a first order gradient directivity characteristic is beneficial. The background thereof is that according to the publication a higher order gradient loudspeaker tends to be less efficient, may use a large number of transducers, more signal processing, and additional channels of amplification, as compared to first order gradient systems.

It has been found out that differential loudspeaker arrays do not have a decreasing directivity as frequency decreases, as do delay-and-sum-beamformers, their level decreases to zero as the frequency goes to zero. Furthermore, first order differential arrays are limited in directivity, to, for example, about 6 dB. Therefore, there is a need for an improved approach.

SUMMARY

According to an embodiment, a device may have a calculation unit for a sound reproduction system including an array having at least three transducers, the calculation unit including: input means for receiving an audio stream to be reproduced using the array; a processor; and at least three outputs for controlling the at least three transducers of the array, wherein the processor is configured to calculate at least three individual audio signals such that a second or higher order acoustic differential is reproduced using the array.

According to another embodiment, a system may have: a calculation unit for a sound reproduction system according to one of the previous claims; and an array having at least three transducers.

According to another embodiment, a method for calculating a sound reproduction for a sound reproduction system including an array having at least three transducers may have the steps of: receiving an audio stream to be reproduced using the array and having a frequency range; calculating at least three individual audio signals, to be output using the at least three outputs, such that a first acoustic differential having a second or higher order is generated using the array; and outputting the at least three audio signals in order to control the at least three transducers of the array.

Another embodiment may have a non-transitory digital storage medium having a computer program stored thereon to perform the method for calculating a sound reproduction for a sound reproduction system including an array having at least three transducers, the method including receiving an audio stream to be reproduced using the array and having a frequency range; calculating at least three individual audio signals, to be output using the at least three outputs, such that a first acoustic differential having a second or higher order is generated using the array; and outputting the at least three audio signals in order to control the at least three transducers of the array, when said computer program is run by a computer.

Another embodiment may have a non-transitory digital storage medium having a computer program stored thereon to perform the method including filtering of the at least three individual audio signals using a first passband characteristic including a first limited portion of the frequency range of the audio stream; and/or further including calculating a respective delay characteristic of the individual audio signals, when said computer program is run by a computer.

An embodiment provides a calculation unit for a sound reproduction system comprising an array having at least three transducers. The calculation unit comprises input means, a processor and at least three outputs. The input means have the purpose to receive an audio stream to reproduce using the array. The audio stream has a predefined frequency range, e.g. from 20 Hz to 20 kHz or from 50 Hz to 40 kHz. Based on this audio stream at least three individual audio signals for the at least three transducers of the array are output using the at least three outputs, after processing the audio stream such that the at least three transducers are controllable via the three individual audio signals. The processor is configured to calculate the (at least) three individual audio signals such that a first acoustic differential having a second or higher order is generated.

The processor may further filter the three individual audio signals using a first passband characteristic comprising a first limited portion of the entire frequency range of the audio stream, e.g. above 50 Hz or 100 Hz or in a range between 100 Hz and 200 Hz or between 100 Hz to 2 kHz.

Teachings disclosed herein are based on the knowledge that an acoustic differential having a second or higher order enables better sound reproduction or, especially, better directivity performance in a certain frequency range, wherein some frequencies out of this certain frequency range may be reproduced faulty. Embodiments according to the teachings disclosed herein are based on the principle that (certain frequency range being a portion of the entire frequency range or, in general,) the complete frequency range is reproduced using the acoustic differential having a second or higher order. The reproduction of a certain frequency range enables a good sound reproduction in this frequency range while avoiding the drawbacks typically caused when performing sound reproduction based on acoustic differentials having a second or higher order in other frequency ranges.

According to an embodiment the sets of loudspeakers are selected with respect to the frequencies to be reproduced, namely such that the distance between the loudspeakers is related to a frequency region within which the differential works well. Typically different loudspeakers/loudspeaker sets are used to cover different frequency ranges.

According to further embodiments at least two further individual audio signals, to be output using two of the at least three (different) outputs, are calculated such that a second acoustic differential having a first order is generated using the two transducers controlled via the two outputs. The processor filters the two further individual audio signals using a second passband characteristic comprising a second limited portion (e.g. up to 100 Hz or 200 Hz) of the entire frequency range of the audio stream. In general, the second limited portion differs from the first limited portion; i.e. sound is reproduced within different frequency ranges using different acoustic differentials.

According to an embodiment an array comprising a number of loudspeakers, for each differential a subset of the loudspeakers, is used. These subsets are chosen such that the loudspeaker distances are such that the corresponding differentials have the desired frequency operating range.

According to a further embodiment an array comprising at least four transducers is used. Thus, the calculation unit comprises at least four outputs for the at least four transducers. Here, the first acoustic differential is generated using at least three of the four outputs belonging to a first group, wherein the processor is configured to calculate three further individual audio signals, to be output using the three of the at least four outputs of a second group, such that a further second or higher order acoustic differential is generated using the array. The processor filters the three further individual audio signals (belonging to the second group) using a passband characteristic comprising a second limited portion of the frequency range of the audio stream. Here, the second limited portion also differs from the first limited portion. Furthermore, it should be noted that at least one output of the outputs of the second group differs from the outputs of the first group; i.e. not the same transducers are used for reproducing the first acoustic differential and the second acoustic differential.

According to further embodiments the process is configured to calculate the individual audio signals such that a zero response of the first acoustic differential and a zero response of the second acoustic differential lies substantially within the same region or at the same point. This means that sound cancellation reproduced by using the first acoustic differential and the sound cancellation reproduced by using the second acoustic differential are performed such that both acoustic differentials generate the same minimum response at the same position or region.

According to further embodiments, the processor performs a calculation based on the formula $$s_1(t)=s(t-\tau_1)$$

$$s_2(t)=-2s(t-\tau_2)$$

$$s_3(t)=s(t-\tau_3),$$

wherein $\tau_1$, $\tau_2$ and $\tau_3$ are delay characteristics corresponding to the three individual audio signals $s_1$, $s_2$ and $s_3$.

The above described principle in regard to reproducing the first acoustic differential may also be applied for the reproduction of an additional acoustic differential reproducing another band (portion) of the entire frequency band. Consequently, three acoustic differentials are used to reproduce three different frequency ranges. For example, the role-off frequencies between the first acoustic differential and the second acoustic differential may be at 300 Hz (in the range between 100 Hz and 400 Hz), wherein the role-off between the second acoustic differential and a third acoustic differential may be at 500 Hz (in the range between 300 Hz and 1000 Hz).

For the reproduction of the additional acoustic differential also other transducers of the array may be used. According to embodiments, the array comprises at least five transducers which are controlled via five outputs of the calculation unit. From another part of view that means that the reproduction of different frequency bands (belonging to the different acoustic differentials) is performed such that a first set of the transducers of the array reproduces the first frequency band, wherein a second set of the transducers of the same array reproduces the second frequency band and a third set of transducers of the array reproduces the third frequency band. Consequently, due to the fact that the sets for the three frequency bands differ from each other, the spacing between the transducers reproducing a respective frequency band differs, too. For example, a spacing between the transducers used for a lower frequency band may be larger than a spacing between the transducers used for reproducing the higher frequency band. According to embodiments the transducers of the array are arranged such that the condition holds true that all transducers of a set of the transducers are equidistant even if some transducers are used for different sets.

According to further embodiments, the above principle may be applied to stereophonic audio streams.

A further embodiment provides a system comprising the above discussed calculation unit and the corresponding array.

According to a further embodiment the corresponding method for calculating the sound reproduction is provided.

BRIEF DESCRIPTION OF THE DRAWINGS

Embodiments of the invention will be detailed subsequently referring to the appended drawings, in which.

DETAILED DESCRIPTION OF THE INVENTION

Figure 1:
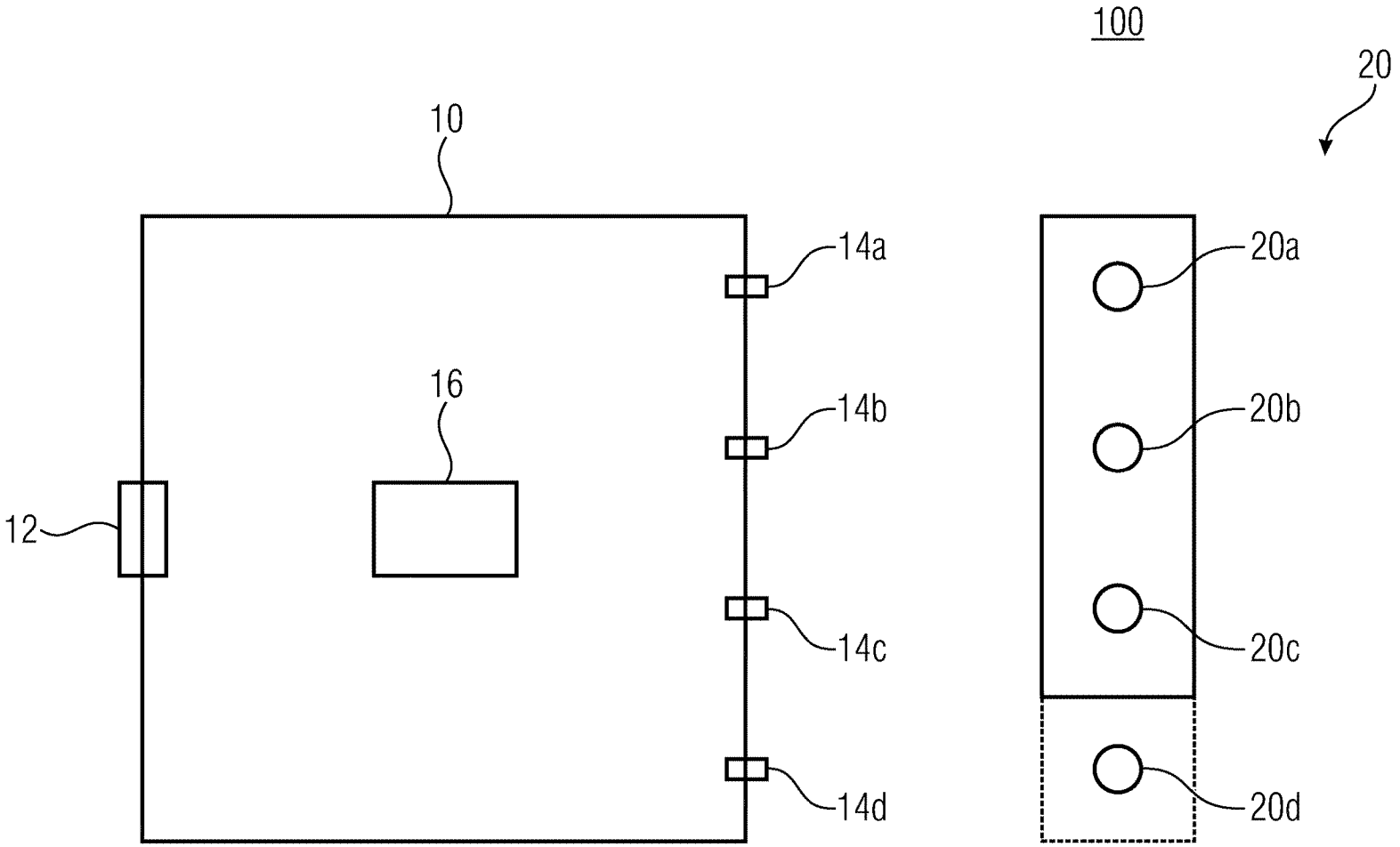
FIG. 1 shows a schematic block diagram of a calculation unit according to a first embodiment.

Below, embodiments of the present invention will subsequently be discussed referring to the figures. Here, the same reference numerals are provided to the same elements, or elements having the same or similar functions. Therefore, the description thereof is interchangeable and mutually applicable.

FIG. 1 shows a calculation unit 10 for a sound reproduction system 100 comprising an array 20 having at least three transducers 20*a*, 20*b*, and 20*c* arranged in line.

The calculation unit 10 comprises input means 12, at least three outputs 14*a*, 14*b* and 14*c* and a processor 16. The input means 12 have the purpose to receive an audio stream to be reproduced using the array 20. The calculation of the reproduction is performed by the processor in order to obtain at least three individual audio signals for the three transducers 20*a*-20*c*. In detail, the three transducers 20*a*-20*c* of the array 20 are controlled using the output 14*a*-14*c*.

In this basic implementation the three individual audio signals are calculated such that a first acoustic differential having at least a second order is generated, wherein the frequency band of this first acoustic differential is limited to a portion (100 Hz to 400 Hz) of the entire frequency range (20 Hz to 20 kHz) of the audio stream. This portion is selected such that "problematic" frequencies (e.g. low frequencies below 100 Hz), which cannot or only ineffectively be reproduced using an acoustic differential having a second order, are suppressed. Vice versa, this means that the first acoustic differential just comprises frequencies which can be reproduced properly using an acoustic differential having the second order. The respective frequency band which is able to be reproduced with higher order and which is unable to be reproduced with this order depends on the array 20, for example on the size of the transducers and, especially, on the spacing between the transducers 20*a*, 20*b*, 20*c*. For example, the reproduction of a higher frequency band involves a smaller spacing when compared to the reproduction of a lower frequency band. In order to limit the portion of the frequency range reproduced by using the first acoustic differential, the processor may perform a filtering or may comprise a (digital) filter entity, like an IIR, to perform the filtering. Thus, the reproduction of the first acoustic differential enables to reproduce the entire audio stream, but with a limited frequency band of the audio stream.

The portions of the frequency band which are not reproduced using the first acoustic differential may be reproduced using other acoustic differentials. Here, a distinction between two principles is made:

According to the first principle the second acoustic differential is provided such that same has a first order (is limited to the order no. 1). The reproduction of an acoustic differential having a first order is typically possible using just two transducers (e.g. 20*a* and 20*c*, controlled by the outputs 14*a* and 14*c*). Therefore, according to an embodiment, the processor 14 performs the calculation of a second acoustic differential having just a first order for another frequency band (which has been referred to as problematic frequency band above. Note that the problematic frequencies depend on the combination with a specific transducer/array configuration). Often, but not necessarily, the frequency band of the second acoustic differential may comprise lower frequencies when compared to the frequency band of the first acoustic differential. Going back to the above statement that lower frequencies are reproduced better using transducers having an increased spacing, the second acoustic differential may be reproduced using the two outer transducers 20*a* and 20*c*, thus the transducers 20*a* and 20*c* having a large spacing in between.

According to another principle the missing (problematic) portions of the frequency range of the audio stream are reproduced using a second acoustic differential, also having a second or higher order. In this case, the concept starts from an array having at least four transducers 20*a*-20*d*, as illustrated by the broken lines. Here, the reproduction of the second acoustic differential is performed such that other transducers, e.g. the transducers 20*a*, 20*c* and 20*d*, (i.e. not the transducers 20*a*, 20*b* and 20*c* of the first acoustic differential), are used. Due to this, the limitations caused when reproducing an acoustic differential of a second or higher order in a problematic frequency range can be overcome by the usage of another transducer configuration/set. In detail, the transducer configuration used for reproducing the second acoustic differential differs from the transducer configuration used for reproducing the first acoustic differential with regard to its spacing between the single transducers or at least the spacing between two transducers of the respective set. Variants of this principle will be discussed in more detail with respect to FIG. 3.

Just for the sake of completeness it should be noted that for this second principle the processor 16 performs the calculation of the second acoustic differential and performs the filtering, such that the second acoustic differential comprises just the frequencies reproducible by using the respective transducer set. Furthermore, the means for outputting the individual audio signals comprising the outputs 14*a*-14*c* are enhanced by at least an additional output 14*d*.

Both above discussed principles from reproducing the second portion of the entire frequency range have in common that the second acoustic differential (first, second or higher order) is reproduced using a set of transducers which differs from the set of transducers used for reproducing the first acoustic differential.

According to a further embodiment the two basic concepts of reproducing the second portion of the entire frequency band may be combined, such that three or more frequency bands may be reproduced by using the three or more acoustic differentials. Here, the acoustic differentials (except the first acoustic differential) may have a first or higher order dependent on the used principle.

Note that the two (bandlimited) frequency ranges are typically separated from each other, but may have a transition region caused by the filter edge. Alternatively the filters for filtering the two frequency portions may be designed to have an overlapping portion.

Below, the background for the above discussed basic embodiments will be explained in detail.

Figure 2A:
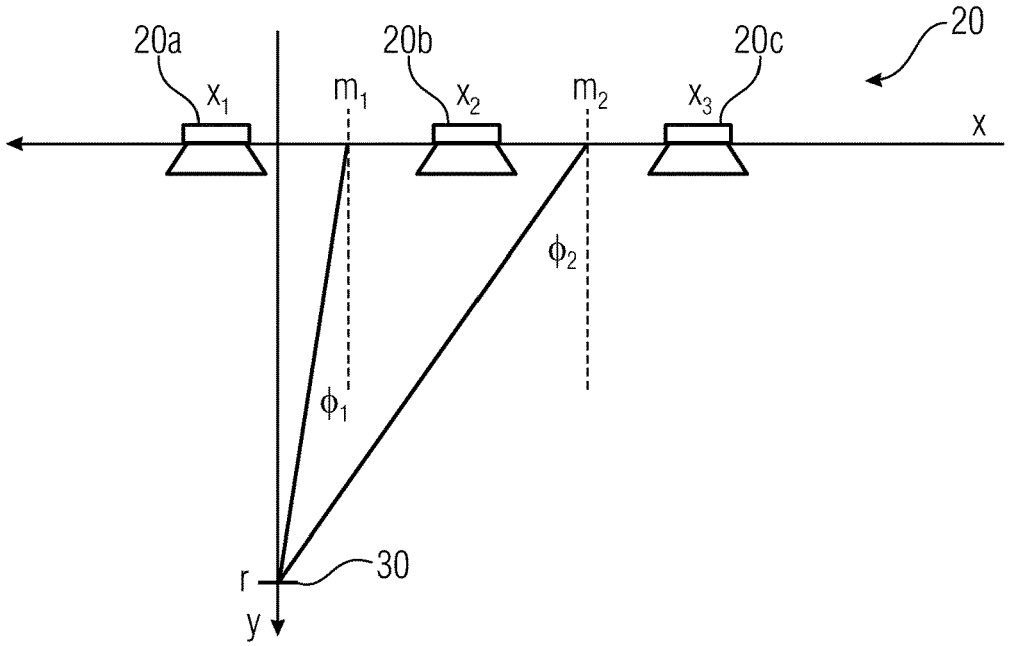
FIG. 2*a* shows schematically three loudspeakers generating a second order acoustic differential and a listening position.

FIG. 2*a* shows three loudspeakers 20*a*, 20*b* and 20*c* at the positions $x_1$, $x_2$ and $x_3$ and a listening point marked by the reference numeral 30. Here, the sound is reproduced with a second order acoustic differential, with zero steering towards the listening point 30.

The second order acoustic differential is generated by subtracting two first order acoustic differentials which point their zero to a common point. Expressed in other words that means that a second order acoustic differential is generated by combining two first order acoustic differentials. A first order acoustic differential with the loudspeakers 20*a* and 20*b* at positions $x_1$ and $x_2$ is generated by $$s_1(t)=s(t-\tau_1)$$

$$s_2(t)=-s(t-\tau_2), \tag{1}$$

The variable $s_1$ and $s_2$ refer to the signals via which the transducers 20*a* and 20*b* are driven. The center of the differential is at x position $$m_1 = \frac{1}{2}(x_1 + x_2).$$

The delays $\tau_1$ and $\tau_2$ are such that a zero is steered from $m_1$ towards the listening position 30. A first order acoustic differential with the loudspeakers 20*b* and 20*c* at positions $x_2$ and $x_3$ is generated by $$s_2=s(t-\tau_2')$$

$$s_3(t)=-s(t-\tau_3). \tag{2}$$

Here, the variables $s_2$ and $s_3$ refer to the signals for the transducers 20*b* and 20*c*. The center of the differential is at x position $m_2=\frac{1}{2}(x_2+x_3)$. The delays $\tau_2'$ and $\tau_3$ are such that a zero is steered from $m_2$ towards the listening position 30, i.e. $\tau_2'=\tau_2$. The two first order differentials are subtracted for generating the second order differential with zero steering towards the listening position 30

$$s_1(t)=s(t-\tau_1)$$

$$s_2(t)=-2s(t-\tau_2)$$

$$s_3=s(t-\tau_3). \tag{3}$$

The directions of the zeros of the first order differentials are $$\phi_1=a\tan 2(r,-m_1)$$

$$\phi_2=a\tan 2(r,-m_2). \tag{4}$$

The steering delays relate to the steering angles as follows:

$$\tau_1-\tau_2=\frac{x_1-x_2}{c}\sin\phi_1 \tag{5}$$

$$\tau_2-\tau_3=\frac{x_2-x_3}{c}\sin\phi_2.$$

Note that the angles $\Phi_1$ and $\Phi_2$ are marked within FIG. 2*a*. The three delays are computed with the additional condition that the smallest delay shall be zero.

This procedure may be expressed in other words, that the delay (and/or inversion) operations may be applied such that the differentials have a zero response in the region of a specific direction or point (cf. point 30).

Figure 2B:
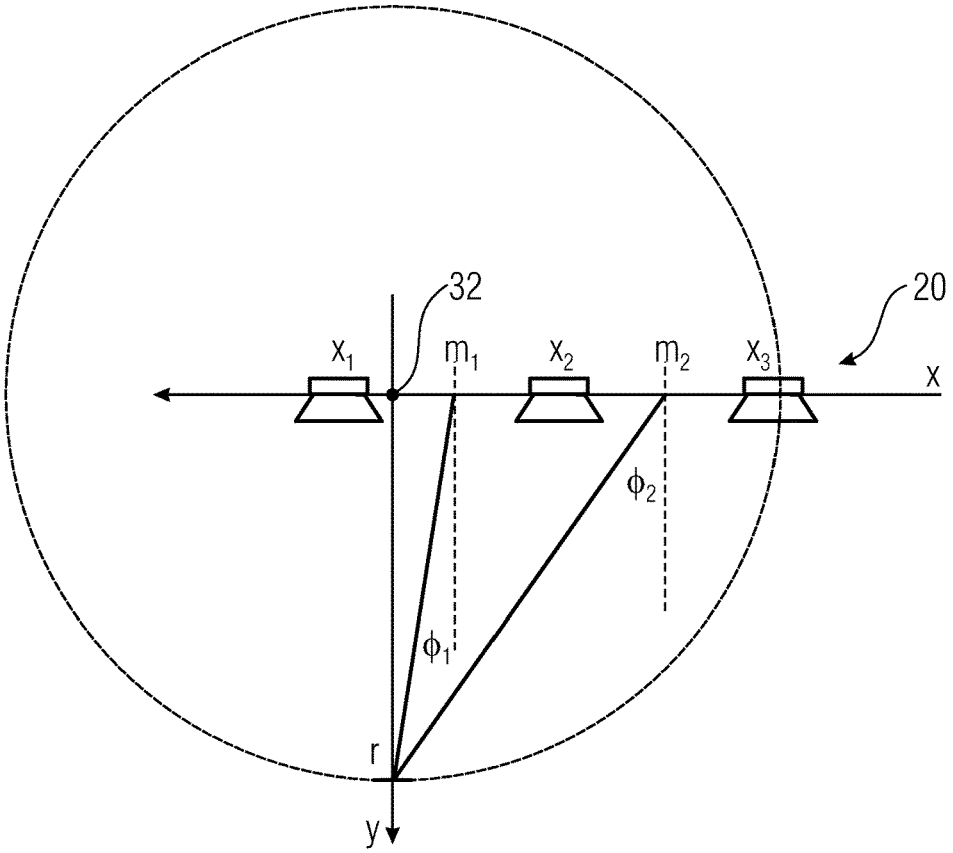
FIG. 2*b* shows schematically the determination of a directivity pattern considered for a listener at distance walking on a circle around the array.

In the following discussion it is considered that the directivity pattern occurs when measuring on a circle with radius r, as illustrated by FIG. 2*b*.

Here, three loudspeakers 20*a*, 20*b* and 20*c* are at $x_1$=0.2 m, $x_2$=−0.6 m, and $x_3$=−1.4 m. By generating an acoustic differential, as discussed with respect to FIG. 2*a*, a directivity pattern considered for a listener at a distance r walking on a circle around the array or around the point 32 of the array may be generated.

Figure 2C:
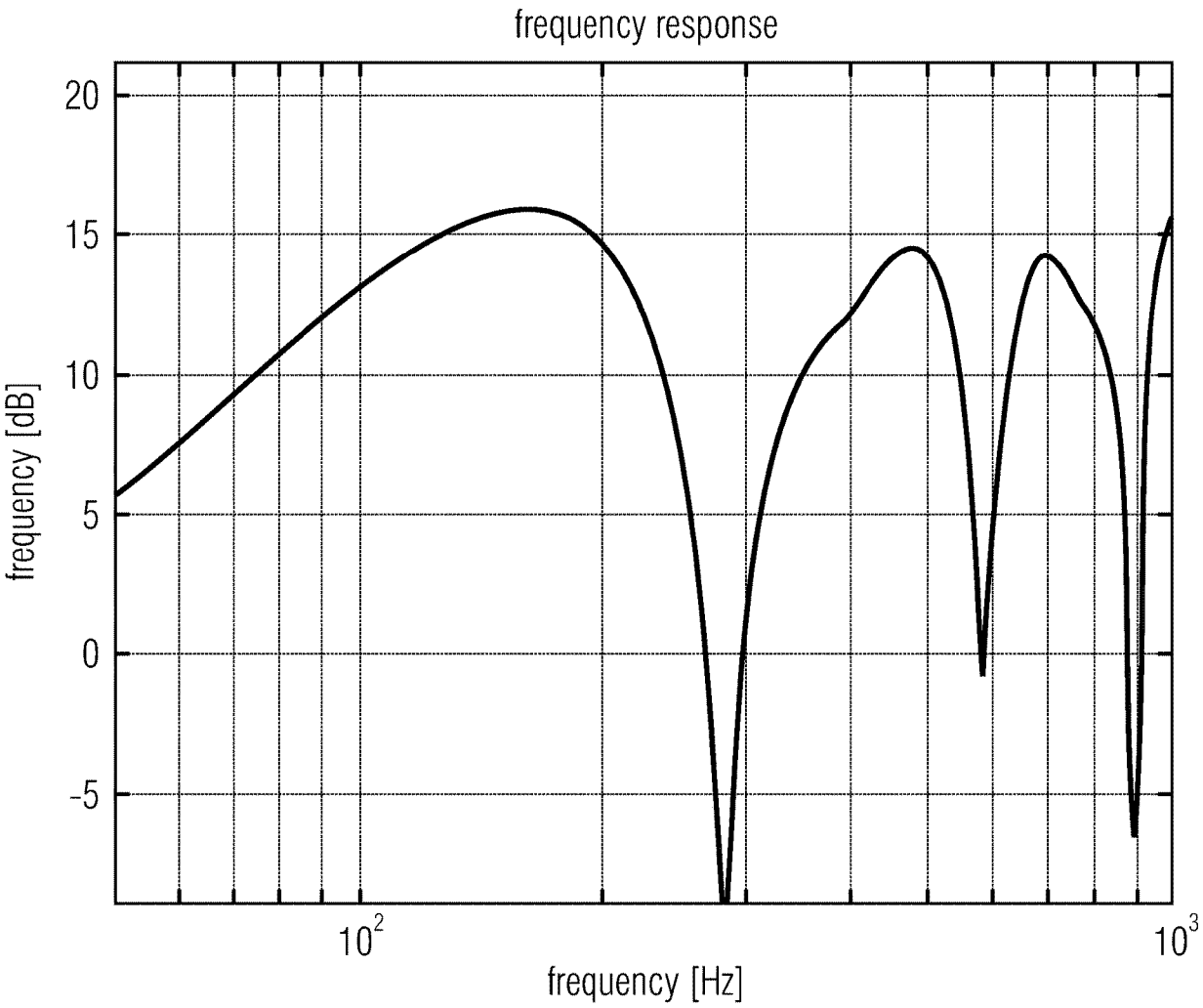
FIG. 2*c* shows a schematic diagram of a frequency response of a second order acoustic differential in look direction.
Figure 2D:
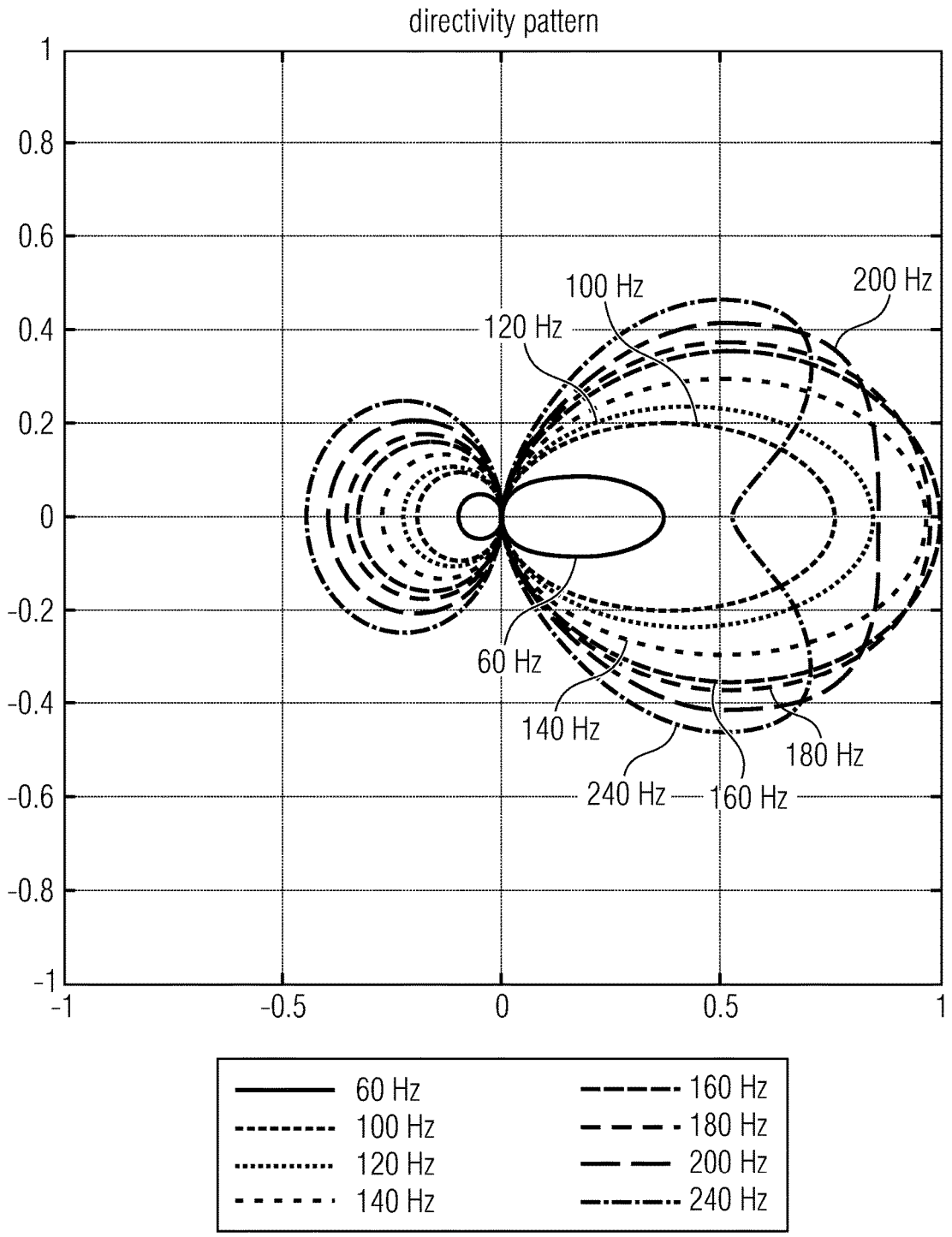
FIG. 2*d* shows a schematic diagram of a directivity pattern of the second order acoustic differential.

The resulting frequency response in negative x-direction (look direction of second order tailed cardioid) is shown by FIG. 2*c*. The operating range is from about 100 Hz to 200 Hz. For lower frequencies, the amplitude is too low, which would involve strong loudspeakers, if the low frequency roll-off would be extended. At higher frequencies, the directivity pattern becomes inconsistent. These frequency-dependent effects are illustrated by FIG. 2*d* illustrating the directivity pattern of the second order acoustic differential. As can be seen, within the operating range (100 to 200 Hz), the directivity patterns are very similar. For lower frequencies, like 60 Hz amplitude is lower, and for higher frequencies, like above 240 Hz the directivity pattern becomes aliased. In accordance to this analysis the first portion of the entire frequency range (which is reproduced using the acoustic differential having second or higher order) is selected. Consequently, the frequency ranges below and above this selected portion. This selected portion (here below 100 Hz and above 200 Hz) have to be reproduced by usage of the second (and third) acoustic differential which is calculated for a varied transducer set as explained above.

As explained, the second order acoustic differential has a limited frequency range within which it provides consistent frequency responses and directivity patterns. Conventionally, in differential microphone and loudspeaker signal processing, relative small distances between microphones/loudspeakers are used in order to shift the operating range to higher frequencies (to prevent aliasing). Then, the lower frequency roll-off is compensated with a low shelving type filter. This procedure has, particularly for loudspeakers, disadvantages, namely that low frequencies are amplified, increasing loudspeaker requirements for low frequency reproduction, which is often unrealistic in lean form factors. Furthermore, for second order the low frequency roll-off is 12 dB per octave, making low frequency roll-off compensation entirely unrealistic.

In order to achieve wider operating bandwidth different sets of loudspeakers for different frequencies should be used. The previously described example (cf. FIG. 2) may be used only within a frequency range of about 100 to 200 Hz. Other sets of loudspeaker triples would be used to cover the frequency ranges 200 to 400 Hz and/or 400 to 800 Hz, etc.

Figure 3:
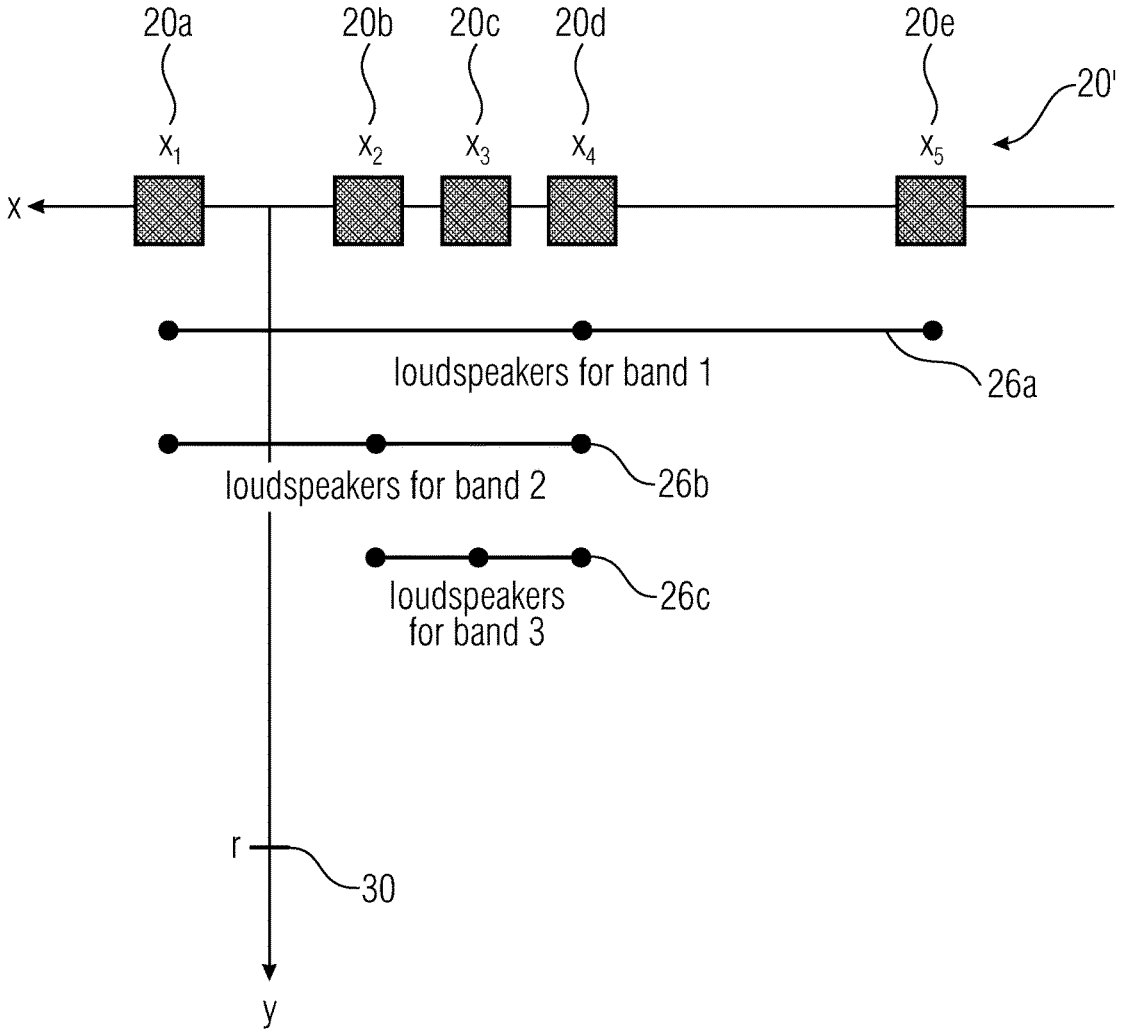
FIG. 3 shows schematically a loudspeaker array for up to three band second order acoustic differential.

Such a loudspeaker setup or loudspeaker array is illustrated by FIG. 3. The array 20' of FIG. 3 comprises five loudspeakers 20*a*-20*e*, which can be used for up to three band second order acoustic differentials. Compared to the example of FIG. 2*a*, two loudspeakers (cf. 20*d* and 20*e*) have been added and the positioning along the x-axes of all loudspeakers 20*a* to 20*e* has been changed. Due to the five loudspeakers three different combinations, each using three loudspeakers are available. These combinations are referred to as triples. The loudspeaker triples used for the three bands are indicated by the reference numerals 26*a*, 26*b* and 26*c*. The first triple 26*a* comprises the loudspeakers 20*a*, 20*d* and 20*e*, the second triple 26*b* comprises the loudspeakers 20*a*, 20*b* and 20*d*, wherein a third triple 26*c* comprises the loudspeakers 20*b*, 20*c* and 20*d*.

As can be seen, the loudspeakers 20*a*-20*e* may be arranged such that loudspeakers 20*a* and 20*d* are spaced apart from each other by a distance which is equal to the distance between the loudspeakers 20*d* and 20*e*. The loudspeaker 20*b* is arranged in the middle between the loudspeakers 20*a* and 20*d*. For example, the first loudspeaker 20*a* may be arranged at the position 0.2 m, the second loudspeaker 20*b* at the position −0.2 m, the third loudspeaker 20*c* at the position −0.4 m, the fourth loudspeaker 20*d* may be arranged at the position −0.6 m, wherein the fifth loudspeaker 20*e* may be arranged at the position −1.2 m. Furthermore, the loudspeaker 20*c* is arranged centered between the loudspeakers 20*b* and 20*d*. Due to this arrangement condition holds true achieved that all loudspeakers of the first triple 26*a*, the second triple 26*b* and the third triple 26*c* are equidistant, even if some transducers are uses for different sets.

Figure 4A:
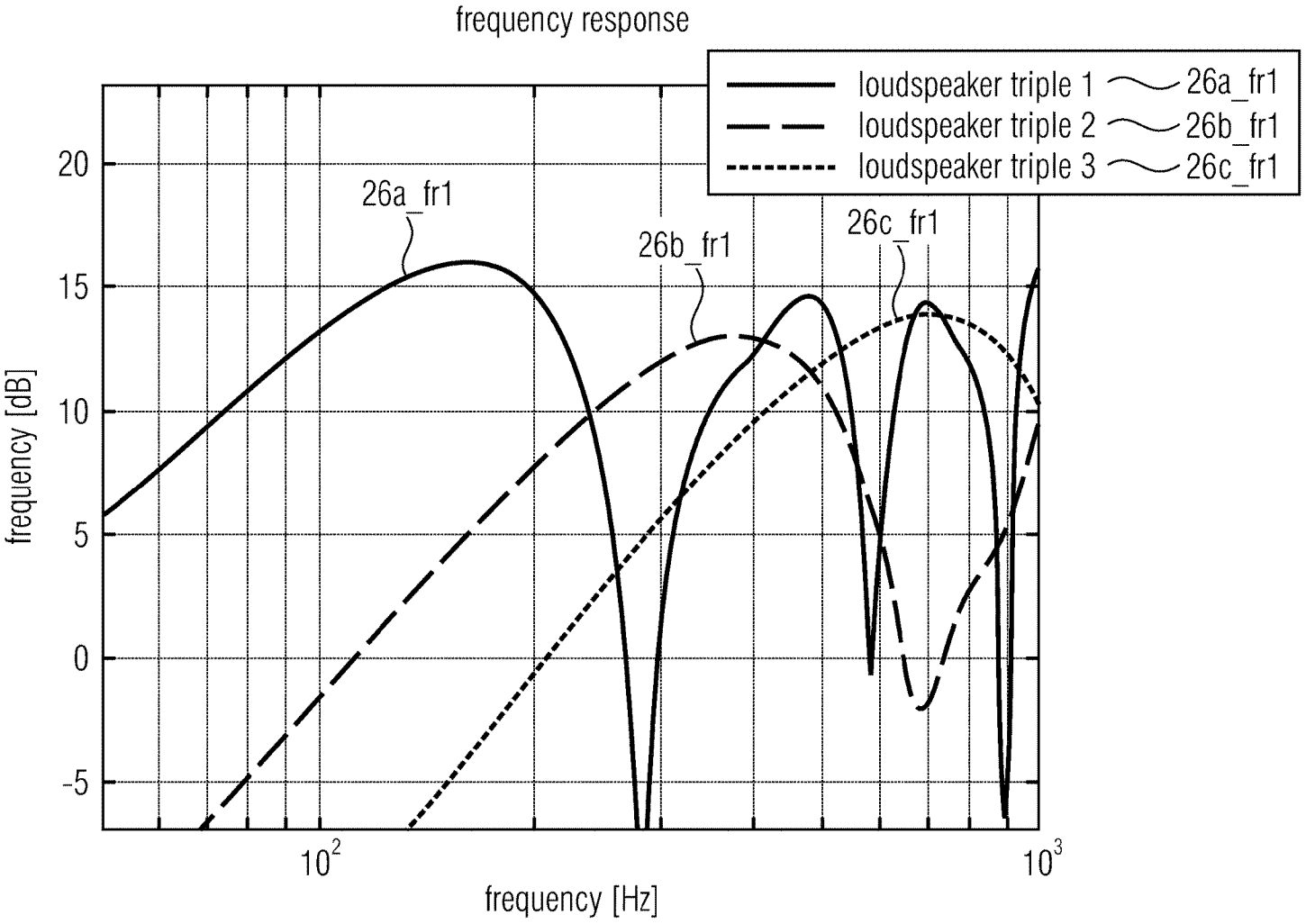
FIG. 4*a* shows a schematic diagram of frequency responses of three dipoles.

FIG. 4*a* shows the frequency response of the three dipoles before filtering same in negative x-direction (look direction of second order tailed cardioid). The frequency response 26*a_fr*1, 26*b_fr*1 and 26*c_fr*1 belong to the triples 26*a*, 26*b* and 26*c* of FIG. 3. This data implies that reasonable subband transition frequencies may be 200 Hz and 500 Hz, or in general between 100 Hz and 300 Hz and between 350 Hz and 800 Hz. For example, the three subbands were implemented with an order 3 IIR full rate filterbank.

Figure 4B:
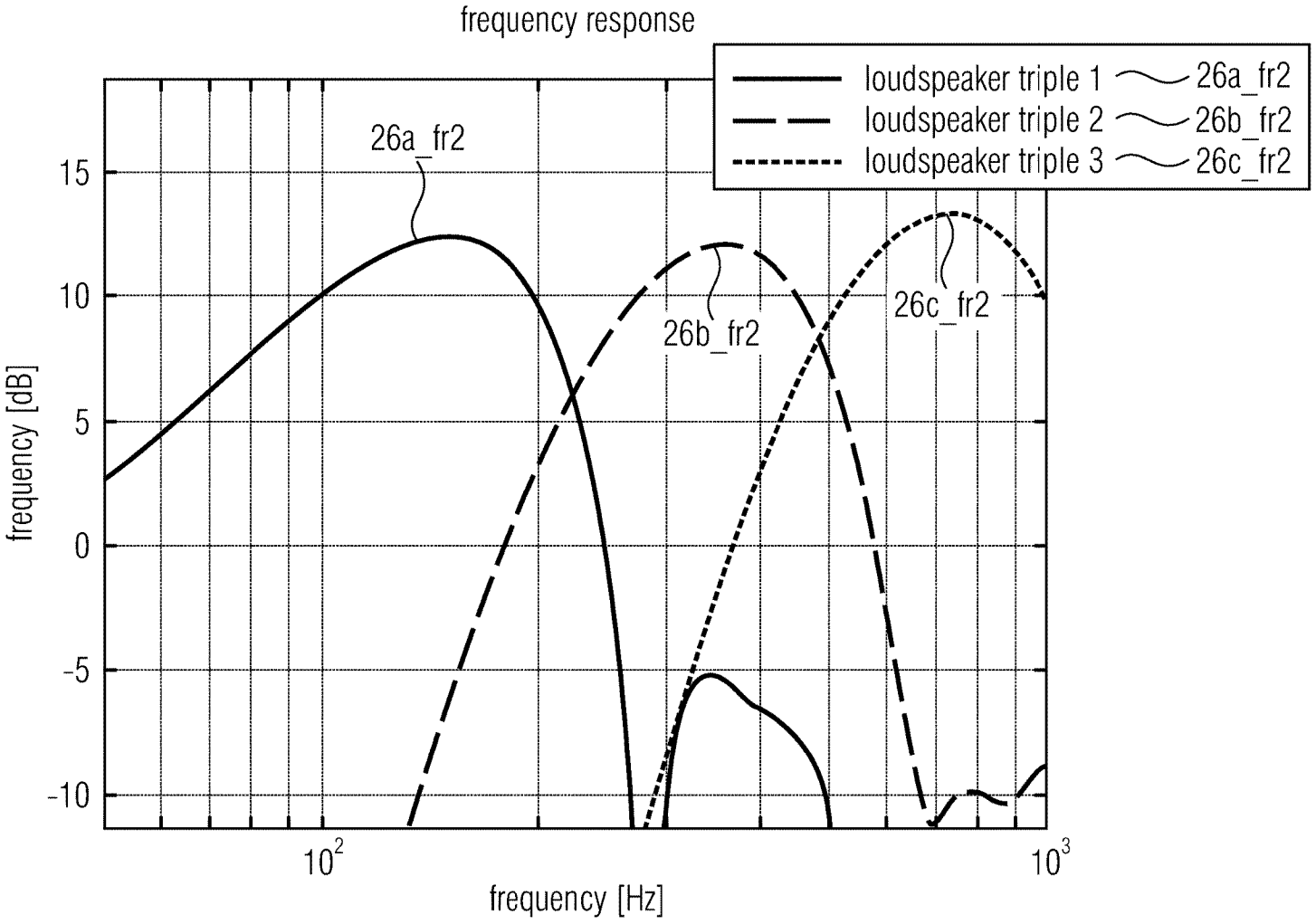
FIG. 4*b* shows a schematic diagram of frequency responses of dipoles with additional subband processing.

The resulting frequency response of the dipoles with additional subband processing is shown by FIG. 4*b*. The frequency response 26*a_fr*2, 26*b_fr*2 and 26*c_fr*2 belong to the triples 26*a*, 26*b* and 26*c* and result from the processing of the frequency responses 26*a_fr*1, 26*b_fr*1 and 26*c_fr*1. Due to different positions of the loudspeakers 20*a*-20*e* of the different loudspeaker triples 26*a*-26*c* used for reproducing subband second order acoustic differentials, delays may cause undesired interference in the transition frequencies of the subbands. To delay align the sound reproduction of the different subband signals, a delay offset may be added to the delays $\tau_1$, $\tau_2$ and $\tau_3$ of formula (5) for the three loudspeakers per subband.

According to further embodiments the proposed technique can also be implemented for higher order acoustic differentials. In this case, three loudspeaker pairs are considered, needing at least four loudspeakers. With the four loudspeakers, 3 first order differentials can be reproduced:

$$s_1(t)=s(t-\tau_1)$$

$$s_2(t)=-s(t-\tau_2), \tag{6}$$

$$s_2(t)=s(t-\tau_2)$$

$$s_3(t)=-s(t-\tau_3), \tag{7}$$

$$s_3(t)=s(t-\tau_3)$$

$$s_4(t)=-s(t-\tau_4). \tag{8}$$

Giving (6) and simultaneously inverted (7) to loudspeakers 1 to 3 reproduces a second order differential (similar to (3)). Giving (7) and simultaneously inverted (8) to loudspeakers 2 to 4 reproduces a second second-order differential. The third order acoustic differential is implemented by simultaneously reproducing the two second order differentials, one inverted:

$$s_1(t)=s(t-\tau_1)$$

$$s_2(t)=-3s(t-\tau_2)$$

$$s_3(t)=3s(t-\tau_3)$$

$$s_4(t)=-s(t-\tau_4). \tag{9}$$

In general, the loudspeaker signals for an acoustic differential of k-th order can be computed as follows:

$$s_n(t) = (-1)^{n-1}\binom{n}{k}s(t-\tau_n) \text{ or} \tag{10}$$

$$s_n(t) = (-1)^{n}\binom{n}{k}s(t-\tau_n) \tag{11}$$

where k is the order of the differential, and n is the loudspeaker number, where n=(1, 2, . . . , k+1). I.e. for a k-th order acoustic differential, k+1 (equidistant) loudspeakers are needed.

The delays are computed with a similar idea as described above for the second order differential.

For example, a simple algorithm for obtaining the delays is:

Set $\tau_1=0$ and compute the (negative or positive) delay $\tau_2$, such that the zero direction of the first order differential is as desired, e.g. points towards a listening point.

Given the previously computed $\tau_2$, compute $\tau_3$ for the second differential such that its zero points to the desired direction.

Given the previously computed $\tau_3$, compute $\tau_4$ for the third differential such that its zero points to the desired direction.

Add an offset to all delays to bring them to the desired range, e.g.

$$\text{offset}=-\min\{\min\{\min\{\tau_1,\tau_2\},\tau_3\},\tau_4\}. \tag{10}$$

When using different subbands, the delay offset added to each subband's loudspeaker signals may be different than (10), i.e. may be determined to reduce interference between the subbands.

Thus, an embodiment provides a method for calculating the delay characteristic for the respective acoustic differentials.

According to another embodiment the processor may be configured to perform inversion operations.

For instance, a loudspeaker pair with a distance between them of 1 m allows doing a dipole of first order with a similar frequency range as a second order dipole with an array of a length 2 m (1 m spacing between the first and second loudspeaker, and 1 m spacing between the second and third loudspeaker).

Figure 5A:
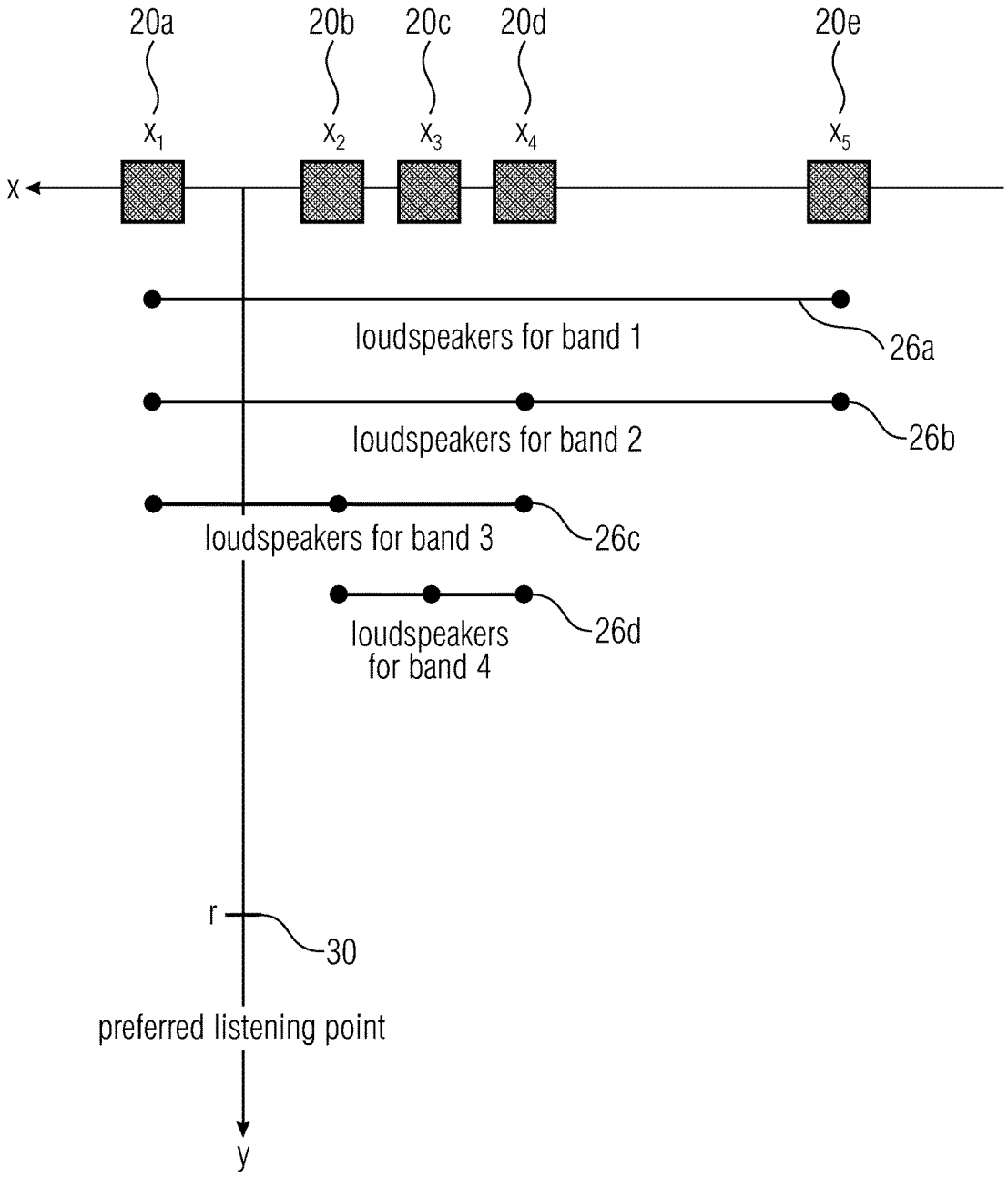
FIGS. 5*a*-5*c* show three exemplary setups of loudspeakers of a loudspeaker array.

Thus, the aperture of the array is limited to a certain size. A first order dipole (26*a* in FIG. 5*a*) can treat a lower frequency range than second order dipoles (26*b*, 26*c*, and 26*d*). This motivates the use of a first order dipole (26*a*) for lower frequencies and second order dipoles (26*b*, 26*c*, and 26*d*) for higher frequencies. An example is shown in FIG. 5*a* using the notification of FIG. 3.

Figure 5B:
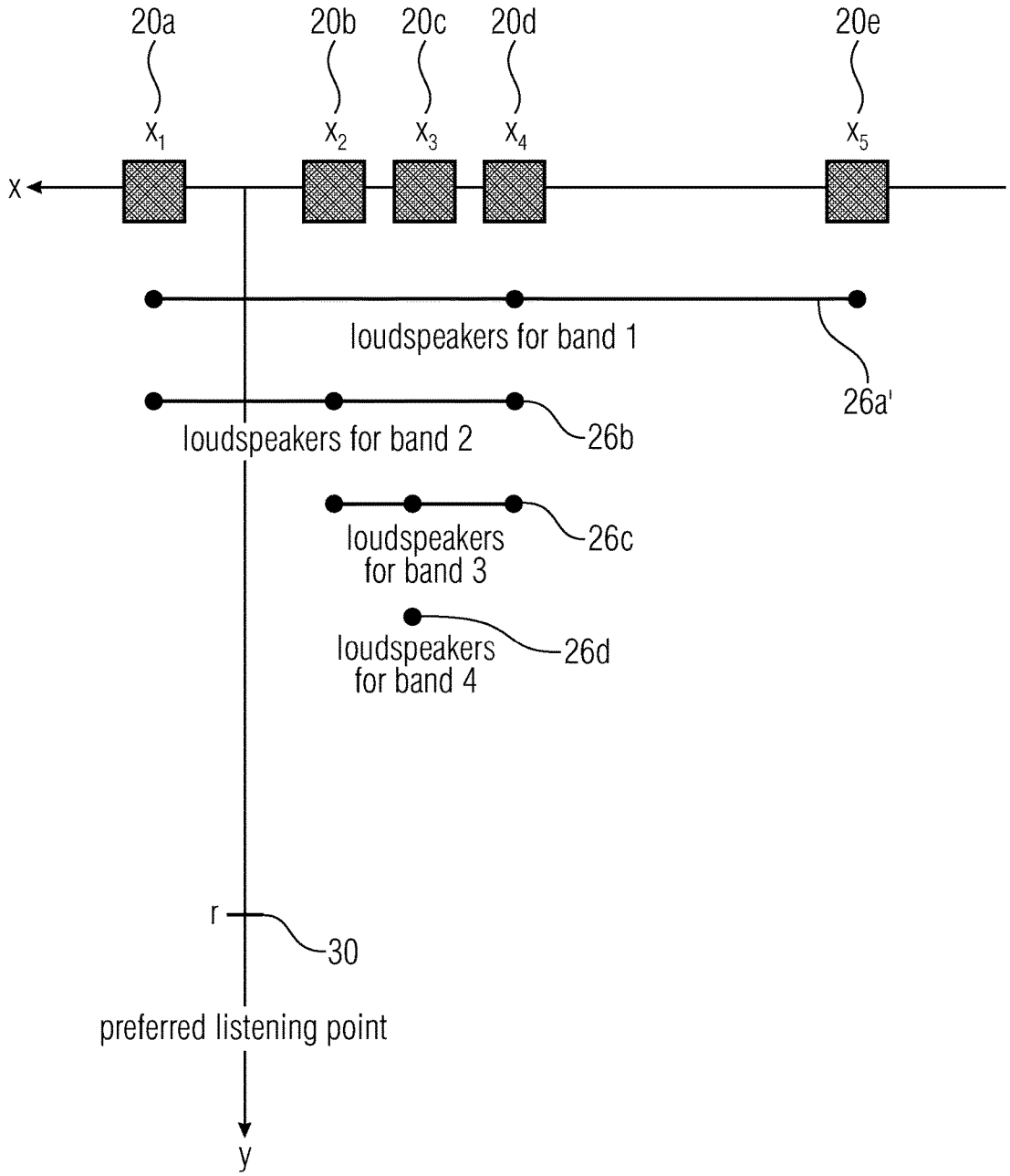

On the contrary, at high frequencies, unless one would use very small loudspeakers, the loudspeaker spacing is too coarse for reproducing a precise acoustic differential. This motivates reproduction of the high frequencies by giving the signals directly to loudspeakers (without attempting to do acoustic differentials). Also, at high frequencies, loudspeakers are usually quite directive. Thus even just a single loudspeaker emits an effective beam towards the direction it is pointing to. Such a setup is shown by FIG. 5*b* using the notification of FIG. 3. Here second order dipoles (26*a*', 26*b* and 26*c*) and one single loudspeaker (26*d*) are used.

Generally speaking, one may use for each frequency band the acoustic differential order giving the best desired performance in the corresponding frequency bands. This may result in different orders being used in different frequency bands.

According to further embodiments the low frequency range may be reproduced or supported using an additional output for a subwoofer. Therefore the calculation unit may comprise a subwoofer output.

Figure 5C:
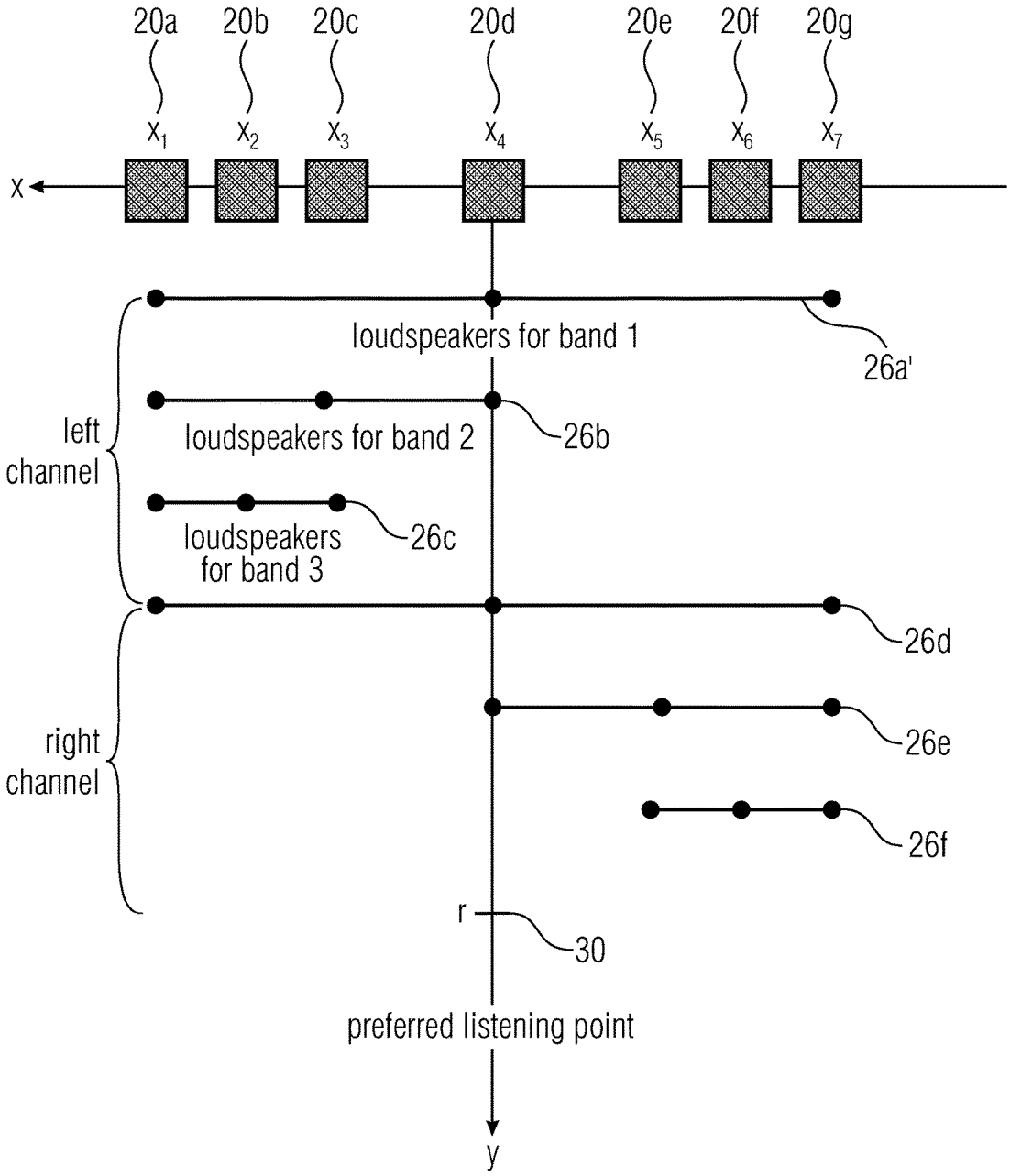

FIG. 5*c* shows a multi-band two channel example. Here, the example setup comprises 7 loudspeakers (20*a*-20*g*) for stereo reproduction. Three second order differentials (26*a*', 26*b*, 26*c*) are used for the left channel and three for the right channel (26*d*, 26*e*, 26*f*). The left channel loudspeaker triples per subband are chosen left oriented, and the right channel loudspeaker triples right oriented. In this example, note, band1 shares the loudspeakers between left and right.

As described, acoustic differentials are reproduced with a loudspeaker pair (first order), triple (second order), or more (higher order). When the loudspeaker locations are left-right symmetric relative to listening position, an acoustic dipole is reproduced, i.e. the directivity characteristic is left-right symmetric. When the loudspeakers are to the left relative to listening position, then the acoustic differential has a left oriented directivity characteristic. Similar for right side. To reproduce two input signals (stereo) one can choose groups of loudspeakers on the left side for reproducing acoustic differentials, to project the left signal to the left side. Similarly, for the right signal, loudspeakers on the right side can be chosen. This enables reproducing of stereo, whereas the left and right signals are projected to the left and right side, resulting in a wide stereo image.

An embodiment provides a calculation unit 10 as defined above, wherein the processor 16 is configured to calculate two further individual audio signals, to be output using two of the added three outputs 14*a*-14*c*, such that a second acoustic differential having first order is generated using the two transducers 20*a*-20*e* controlled via the two outputs 14*a*-14*c*, and wherein the processor 16 is configured to filter the two further individual audio signals using a second passband characteristic comprising a second limited portion of the frequency range of the audio stream which differs from the first limited portion.

With respect to the above embodiments it should be noted that the transducers 20*a*-20*e* of the array 20/20' may be arranged in a common enclosure. Alternatively, the array 20/20' may be formed by a plurality of transducers 20*a*-20*e*, each transducers 20*a*-20*e* (or at least two of the transducers 20*a*-20*e*) having a separate enclosure.

The calculation unit 10 may according to embodiments further comprise at least five outputs (cf. 14*a*-14*d*+an additional output) for five transducers 20*a*-20*e*, wherein the first acoustic differential is generated using at least three of the five outputs 14*a*-14*d* belonging to a first group, wherein the second acoustic differential is generated using at least two of the five outputs 14*a*-14*d* belonging to a second group, and wherein the third acoustic differential is generated using at least two of the five outputs 14*a*-14*d* belonging to a third group, and wherein the first, second and third group differ from each other with respect to at least one output 14*a*-14*d*.

The sound reproduction may according to embodiments be based on the first acoustic differential having second or higher order and a further acoustic differential limited to the first order.

According to further embodiments the calculation unit may comprise an additional output for a subwoofer, wherein the processor 16 is configured to calculate based on the audio stream and to filter the subwoofer audio signal using a passband characteristic comprising a frequency range of the audio stream which is lower than the frequency range of the first limited portion, of the second limited portion and/or of the third limited portion.

The audio stream may be a stereophonic stream. i.e. the processor 16 may be configured to calculate the first acoustic differential of a lobe pointing to a left side reproducing a left channel of the stereophonic stream, and a second acoustic differential with a lobe pointing to a right side reproducing a right channel of the stereophonic stream.

Optionally the audio stream may be a multichannel stream (e.g. a 5.1-stream). In this case, the processor 16 may be configured to render the multichannel stream such that same can be reproduced by using the above described array.

A further embodiment provides a system comprising the above discussed apparatus/calculation unit and an array comprising at least three transducers.

An embodiment provides a system comprising:

a calculation unit 10 for a sound reproduction; and an array (cf. array 20) having at least three or four transducers 20*a*-20*e*, wherein the transducers 20*a*-20*e* used for generating the second acoustic differential having the first order are spaced apart from each other by a distance which is larger than the distance between the transducers 20*a*-20*e* used for generating the first acoustic differential, or wherein the transducers 20*a*-20*e* controlled via the outputs 14*a*-14*d* of the second group are spaced apart from each other by a distance which is larger than a distance between the transducers 20*a*-20*e* controlled via the outputs 14*a*-14*d* belonging to the first group.

Also, the above embodiments have been discussed with respect to an apparatus for calculating the single acoustic differentials, a further embodiment refers to the corresponding method.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive processed (encoded) audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

It should be noted that the above used audio stream may be a multichannel audio stream or a stereophonic stream or an ambience stream.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A calculation unit for a sound reproduction system comprising an array comprising at least three transducers, the calculation unit comprising:

an input unit for receiving an audio stream to be reproduced using the array;

a processor; and at least three outputs for controlling the at least three transducers of the array, wherein the processor is configured to calculate at least three individual audio signals such that a second or higher order acoustic differential is reproduced using the array, wherein the processor is configured to calculate a second order acoustic differential based on the formula $$s_1(t)=s(t-\tau_1)$$

$$s_2(t)=-2s(t-\tau_2)$$

$$s_3(t)=s(t-\tau_3),$$

wherein respective τ1, τ2 and τ3 are delay characteristics corresponding to the three individual audio signals s1, s2 and s3, or calculate a higher order acoustic differential based on the formula $$s_n(t) = (-1)^{n-1}\binom{n}{k}s(t-\tau_n) \text{ or } s_n(t) = (-1)^{n}\binom{n}{k}s(t-\tau_n),$$

wherein respective τn (τ1, . . . , τk+1) are delay characteristics corresponding to the n individual audio signals that are needed for a differential of k-th order.

2. The calculation unit according to claim 1, wherein the processor is configured to calculate the individual audio signals such that the second or higher order acoustic differential comprises a zero response towards the listening region.

3. The calculation unit according to claim 1, wherein processor is configured to split up the received audio stream into at least two frequency bands and to calculate the individual audio signals for the at least two frequency bands, wherein at least two different subsets of loudspeakers are controlled via the audio signals of the at least two frequency bands such that a second or higher order acoustic differential is reproduced within the at least two frequency bands.

4. The calculation unit according to claim 3, wherein a roll-off frequency between a first and a second band of the at least two frequency bands lies within a range between 50 Hz and 400 Hz and/or wherein a roll-off frequency between the second and a further band lies within a range between 100 Hz and 1000 Hz.

5. The calculation unit according to claim 1, wherein processor is configured to split up the received audio stream into at least two frequency bands and to calculate the individual audio signals for a first of the two frequency bands and/or to calculate audio signals for a second one of the at least two frequency bands, wherein audio signals of the second frequency band or of an entire frequency range of the received audio stream are given directly to one or more transducers.

6. The calculation unit according to claim 1, wherein processor is configured to split up the received audio stream into at least two frequency bands and to calculate the individual audio signals for a first of the two frequency bands and/or audio signals for a second of the at least two frequency bands, wherein audio signals of the second frequency band are reproduced by means of the array using a first order acoustic differential or by means of a loudspeaker pair for reproducing the first order acoustic differential.

7. The calculation unit according to claim 1, wherein the audio stream comprises at least two input signals, and wherein processor is configured to calculate individual audio signals for at least a first of the two input signals and for at least a second of the two input signals, wherein the individual audio signals for the first and the second input signals differ from each other with regard to the used loudspeakers or applied parameters.

8. The calculation unit according to claim 1, wherein the array comprises a left-right symmetric loudspeaker setup, wherein the audio stream comprises at least two input signals for at least two channels, and wherein processor is configured to render individual audio signals for a first of the two channels and for a second of the two channels, where the individual audio signals for the first channel comprise acoustic differentials output via left oriented loudspeakers of the array and where the individual audio signals for the second channel comprise acoustic differentials output via right oriented loudspeakers of the array.

9. The calculation unit according to claim 1, wherein the array comprises a left-right symmetric loudspeaker setup; and wherein a most left and a most right transducer are used for low frequencies.

10. The calculation unit according to claim 1, wherein the array comprises a left-right symmetric loudspeaker setup, wherein the audio stream comprises at least four input signals for at least four channels, and wherein processor is configured to render individual audio signals for a first and third of the four channels and for a second and fourth of the four channels, where the individual audio signals for the first and third channel comprise acoustic differentials output via left oriented loudspeakers of the array and where the individual audio signals for the second and fourth channel comprise acoustic differentials output via right oriented loudspeakers of the array.

11. The calculation unit according to claim 1, comprising at least four outputs for at least four transducers, wherein the first acoustic differential is generated using at least three of the four outputs belonging to a first group, and wherein the processor is configured to calculate three further individual audio signals, to be output using three of the at least four outputs of a second group, such that a further second or higher order acoustic differential is generated using the array, wherein the processor is configured to filter the three further individual audio signals using a passband characteristic comprising a second limited portion of the frequency range of the audio stream which differs from the first limited portion, and wherein at least one output of the outputs of the second group differs from the outputs of the first group.

12. The calculation unit according to claim 1, wherein the processor calculates the individual audio signals such that the individual audio signals differ from each other with regard to a delay characteristic, a phase characteristic and/or a magnitude characteristic.

13. A system comprising:

a calculation unit for a sound reproduction system according to claim 1; and an array comprising at least three transducers.

14. A method for calculating a sound reproduction for a sound reproduction system comprising an array comprising at least three transducers, the method comprising:

receiving an audio stream to be reproduced using the array and comprising a frequency range;

calculating at least three individual audio signals, to be output using the at least three outputs, such that a first acoustic differential comprising a second or higher order is generated using the array, wherein a second order acoustic differential is calculated based on the formula $$s_1(t)=s(t-\tau_1)$$

$$s_2(t)=-2s(t-\tau_2)$$

$$s_3(t)=s(t-\tau_3),$$

wherein respective τ1, τ2 and τ3 are delay characteristics corresponding to the three individual audio signals s1, s2 and s3, or a higher order acoustic differential is calculated based on the formula $$s_n(t) = (-1)^{n-1}\binom{n}{k}s(t-\tau_n) \text{ or } s_n(t) = (-1)^{n}\binom{n}{k}s(t-\tau_n),$$

wherein respective τn (τ1, . . . , τk+1) are delay characteristics corresponding to the n individual audio signals that are needed for a differential of k-th order; and outputting the at least three audio signals in order to control the at least three transducers of the array.

15. The method according to claim 14, further comprising filtering the at least three individual audio signals using a first passband characteristic comprising a first limited portion of the frequency range of the audio stream; and/or further comprising calculating a respective delay characteristic of the individual audio signals.

16. A non-transitory digital storage medium having a computer program stored thereon to perform the method for calculating a sound reproduction for a sound reproduction system comprising an array comprising at least three transducers, the method comprising:

receiving an audio stream to be reproduced using the array and comprising a frequency range;

calculating at least three individual audio signals, to be output using the at least three outputs, such that a first acoustic differential comprising a second or higher order is generated using the array, wherein a second order acoustic differential is calculated based on the formula $$s_1(t)=s(t-\tau_1)$$

$$s_2(t)=-2s(t-\tau_2)$$

$$s_3(t)=s(t-\tau_3),$$

wherein respective τ1, τ2 and τ3 are delay characteristics corresponding to the three individual audio signals s1, s2 and s3, or a higher order acoustic differential is calculated based on the formula $$s_n(t) = (-1)^{n-1}\binom{n}{k}s(t-\tau_n) \text{ or } s_n(t) = (-1)^{n}\binom{n}{k}s(t-\tau_n),$$

wherein respective τn (τ1, . . . , τk+1) are delay characteristics corresponding to the n individual audio signals that are needed for a differential of k-th order; and outputting the at least three audio signals in order to control the at least three transducers of the array, when said computer program is run by a computer.

17. A non-transitory digital storage medium having a computer program stored thereon to perform the method of claim 16, the method further comprising:

filtering of the at least three individual audio signals using a first passband characteristic comprising a first limited portion of the frequency range of the audio stream; and/or further comprising calculating a respective delay characteristic of the individual audio signals, when said computer program is run by a computer.

* * * * *